US007758690B2

(12) United States Patent
Nutbeem et al.

(10) Patent No.: US 7,758,690 B2
(45) Date of Patent: Jul. 20, 2010

(54) PAPER COATING PIGMENTS

(75) Inventors: Christopher Nutbeem, St Austell (GB); David O. Cummings, Warthen, GA (US); John C. Husband, St. Austell (GB); Dave R. Skuse, Truro (GB)

(73) Assignee: Imerys Minerals, Ltd., Par Cornwall (GB)

( * ) Notice: Subject to any disclaimer, the term of this patent is extended or adjusted under 35 U.S.C. 154(b) by 834 days.

(21) Appl. No.: 10/511,203

(22) PCT Filed: Jan. 29, 2003

(86) PCT No.: PCT/US03/01064

§ 371 (c)(1),
(2), (4) Date: Aug. 22, 2005

(87) PCT Pub. No.: WO03/093577

PCT Pub. Date: Nov. 13, 2003

(65) Prior Publication Data

US 2006/0102304 A1 May 18, 2006

Related U.S. Application Data

(60) Provisional application No. 60/377,270, filed on May 3, 2002.

(51) Int. Cl.

| | |
|---|---|
| ***C09D 1/00*** | (2006.01) |
| ***C04B 14/04*** | (2006.01) |
| ***C09C 1/02*** | (2006.01) |
| ***D21H 11/00*** | (2006.01) |

(52) U.S. Cl. ..... 106/486; 106/286.5; 106/463; 106/464; 162/181.8

(58) Field of Classification Search ..... 106/486, 106/286.5, 463–464; 162/181.8
See application file for complete search history.

(56) References Cited

U.S. PATENT DOCUMENTS

| | | | | |
|---|---|---|---|---|
| 3,661,610 | A | | 5/1972 | Ferris |
| 3,674,529 | A | | 7/1972 | Toms |
| 4,298,652 | A | | 11/1981 | Suzuki et al. |
| 4,492,628 | A | * | 1/1985 | Young et al. ..... 209/5 |
| 4,714,603 | A | | 12/1987 | Vanderheiden |
| 4,806,167 | A | | 2/1989 | Raythatha |
| 4,820,554 | A | | 4/1989 | Jones et al. |
| 4,842,772 | A | | 6/1989 | Withiam |
| 4,888,160 | A | * | 12/1989 | Kosin et al. ..... 423/432 |
| 5,082,887 | A | | 1/1992 | Brown et al. |
| 5,100,472 | A | | 3/1992 | Fugitt et al. |
| 5,120,365 | A | | 6/1992 | Kogler |
| 5,151,124 | A | | 9/1992 | Rice |
| 5,219,660 | A | | 6/1993 | Wason et al. |
| 5,236,989 | A | | 8/1993 | Brown et al. |
| 5,262,239 | A | | 11/1993 | Wason et al. |
| 5,312,485 | A | | 5/1994 | Wason et al. |
| 5,344,487 | A | | 9/1994 | Whalen-Shaw |
| 5,352,287 | A | | 10/1994 | Wason et al. |
| 5,439,558 | A | | 8/1995 | Bergmann et al. |
| 5,670,242 | A | | 9/1997 | Asano et al. |
| 5,833,747 | A | | 11/1998 | Bleakley et al. |
| 5,853,870 | A | | 12/1998 | Uchimura et al. |
| 5,861,209 | A | | 1/1999 | Haskins et al. |
| 5,866,747 | A | * | 2/1999 | Barger ..... 585/711 |
| 5,882,396 | A | | 3/1999 | Hiorns |
| 5,985,424 | A | | 11/1999 | DeMatte et al. |

(Continued)

FOREIGN PATENT DOCUMENTS

| | | |
|---|---|---|
| EP | 0 355 521 B1 | 2/1990 |

(Continued)

OTHER PUBLICATIONS

Derwent Abstract of JP 05 148796 A, Mitsubishi Paper Mills Ltd., Jun. 15, 1993.

(Continued)

*Primary Examiner*—Jerry Lorengo
*Assistant Examiner*—Shuangyi Abu Ali
(74) *Attorney, Agent, or Firm*—Finnegan, Henderson, Farabow, Garrett & Dunner, L.L.P.

(57) ABSTRACT

A coating composition for paper and other substrates, particularly mechanical papers such as lightweight coated (LWC) paper, comprises an aqueous suspension of a particulate pigment together with a binder, wherein the particulate pigment comprises: (a) a first component which is a precipitated calcium carbonate consisting predominantly of aragonitic or rhombohedral particle shapes or of aragonitic and rhombohedral particle shapes in a weight ratio of between around 40:60 and about 60:40 (e.g. about 50:50) aragonitic: rhombohedral, and a second component which is a processed particulate hydrous kaolin clay having a shape factor greater than or equal to about 25 and a steepness greater than or equal to about 20; or (b) a first component which is a fine particulate calcium carbonate consisting predominantly of particles having a generally spherical particle shape, and a second component which is a processed particulate hydrous kaolin clay having a shape factor greater than or equal to about 45 and a mean equivalent particle diameter ($d_{50}$) less than about 0.5 μm; or (c) a first component which is a precipitated calcium carbonate consisting predominantly of aragonitic and rhombohedral particle shapes in a weight ratio of between about 40:60 and about 60:40 (e.g. about 50:50) aragonitic:rhombohedral, and a second component which is a processed particulate hydrous kaolin clay having a shape factor less than about 25.

55 Claims, No Drawings

U.S. PATENT DOCUMENTS

| | | | | |
|---|---|---|---|---|
| 6,004,467 | A | 12/1999 | Bleakley | |
| 6,143,064 | A | 11/2000 | Virtanen | |
| 6,197,155 | B1 | 5/2001 | Wurster et al. | |
| 6,251,356 | B1 * | 6/2001 | Mathur | 423/432 |
| 6,284,034 | B1 | 9/2001 | Hiorns et al. | |
| 6,312,511 | B1 | 11/2001 | Bilimoria et al. | |
| 6,440,209 | B1 | 8/2002 | Ravishankar et al. | |
| 6,482,581 | B1 | 11/2002 | Govers et al. | |
| 6,511,536 | B1 | 1/2003 | Noguchi et al. | |
| 6,602,484 | B1 | 8/2003 | Virtanen | |
| RE38,301 | E | 11/2003 | Bleakley et al. | |
| 6,699,318 | B1 | 3/2004 | Virtanen | |
| 6,758,895 | B2 * | 7/2004 | Wesley | 106/486 |
| 6,808,559 | B2 * | 10/2004 | Golley et al. | 106/486 |
| 6,811,600 | B2 | 11/2004 | Mathur et al. | |
| 6,887,351 | B1 | 5/2005 | Lunden et al. | |
| 7,048,900 | B2 * | 5/2006 | Mathur et al. | 423/331 |
| 2001/0026869 | A1 | 10/2001 | Wicher et al. | |
| 2005/0031805 | A1 | 2/2005 | Fugitt et al. | |

FOREIGN PATENT DOCUMENTS

| | | | |
|---|---|---|---|
| EP | 0 521 737 | A1 | 1/1993 |
| EP | 0 528 078 | A1 | 2/1993 |
| EP | 0 587 692 | B1 | 3/1994 |
| EP | 0 624 686 | A1 | 11/1994 |
| EP | 0 713 548 | B1 | 5/1996 |
| EP | 0 768 344 | A2 | 4/1997 |
| EP | 0 949 201 | A1 | 10/1999 |
| EP | 0 981 667 | B1 | 3/2000 |
| EP | 1 021 621 | B1 | 7/2000 |
| EP | 1 052 227 | A2 | 11/2000 |
| EP | 1 114 735 | A2 | 7/2001 |
| EP | 1 160 201 | A2 | 12/2001 |
| EP | 1 270 247 | B1 | 1/2003 |
| GB | 2 240 398 | A | 7/1991 |
| JP | 01-170900 | | 2/1991 |
| JP | 02-077045 | | 12/1991 |
| JP | 02-305380 | | 7/1992 |
| JP | 03-240243 | | 3/1993 |
| JP | 03-341097 | | 7/1993 |
| JP | 04-189000 | | 1/1994 |
| JP | 04-242579 | | 3/1994 |
| JP | 04-315408 | | 6/1994 |
| JP | 05-092901 | | 11/1994 |
| JP | 10-289884 | | 7/1999 |
| JP | 10-113780 | | 11/1999 |
| JP | 2001-005947 | | 7/2002 |
| JP | 2001-225501 | | 2/2003 |
| JP | 2002-113450 | | 11/2003 |
| WO | WO 98/56860 | | 12/1998 |
| WO | WO 99/51815 | | 10/1999 |
| WO | WO 00/40424 | | 7/2000 |
| WO | WO 00/66509 | | 11/2000 |
| WO | WO 00/66510 | | 11/2000 |
| WO | WO00/66510 | A1 * | 11/2000 |
| WO | WO02/16511 | A1 * | 2/2002 |
| WO | WO 03/054300 | A1 | 7/2003 |
| WO | WO 03/093577 | A1 | 11/2003 |
| WO | WO 2004/059079 | A2 | 7/2004 |
| WO | WO 2004/114014 | A1 | 12/2004 |
| WO | WO 2005/033403 | A1 | 4/2005 |
| WO | WO 2005/061386 | A1 | 7/2005 |

OTHER PUBLICATIONS

D.B. Crawshaw et al., "The Influence of Pigment Particle Shape on the Performance of Paper Coating," Coating Conference 1982, pp. 143-164.

R.W. Hagemeyer, "The Effect of Particle Shape and Chemical Composition on the Packing Characteristics of Pigment Combinations," *Tappi*, vol. 47, No. 2, Feb. 1964, pp. 74-77.

R.W. Hagemeyer, "The Effect of Pigment Combination and Solids Concentration on Particle Packing and Coated Paper Characteristics," *Tappi*, vol. 43, No. 3, Mar. 1960, pp. 277-288.

R. Grant et al., "Coated-Paper Producers Look Forward to Brighter Times," *PPI*, May 1994, pp. 18, 20, 25-27, 29, 31.

English Abstract for EP 0 713 548 B1, May 29, 1996.

English Abstract for EP 1 021 621 B1, Jul. 26, 2000.

English Abstract for JP 2001-005947, Jul. 31, 2002.

English Abstract for JP 2002 113450, Nov. 28, 2003.

English Abstract for JP 01-170900, Feb. 21, 2001.

English Abstract for JP 02-077045, Dec. 9, 1991.

English Abstract for JP 02-305380, Jul. 2, 1992.

English Abstract for JP 03-240243, Mar. 9, 1993.

English Abstract for JP 03-341097, Jul. 9, 1993.

English Abstract for JP 04-189000, Jan. 18, 1994.

English Abstract for JP 04-242579, Mar. 8, 1994.

English Abstract for JP 04-315408, Jun. 7, 1994.

English Abstract for JP 05-092901, Nov. 1, 1994.

English Abstract for JP 10-289884, Jul. 27, 1999.

English Abstract for JP 10-113780, Nov. 2, 1999.

English Abstract for JP 2001-225501.

* cited by examiner

PAPER COATING PIGMENTS

RELATED APPLICATION

This PCT application claims the benefit of priority under 35 U.S.C. §119(e) to U.S. Provisional Application No. 60/377,270, filed May 3, 2002, entitled "PAPER COATING PIGMENTS," the disclosure of which is incorporated by reference herein in its entirety.

FIELD OF THE INVENTION

The present invention relates to paper coating pigments. More particularly, the present invention relates to a paper coating composition comprising a processed ("engineered") particulate kaolin clay and particulate calcium carbonate, to methods for preparing the composition, to the use of the composition in paper coating, and to coated paper prepared using the composition. In this specification the expression "paper" embraces paper, board, card, paperboard and the like.

BACKGROUND OF THE INVENTION

Coated paper is used for a large range of products including packaging, art paper, brochures, magazines, catalogues and leaflets. Such coated paper is required to give a range of properties, including brightness, opacity and sheet gloss, as well as printing performance.

Paper coating compositions are generally prepared by forming a fluid aqueous suspension of particulate pigment material together with a binder and other optional ingredients. Lightweight coated, or LWC, paper is generally coated to a coating weight of from about 5 $g \cdot m^{-2}$ to about 13 $g \cdot m^{-2}$ on each side, and the total grammage, or weight per unit area of the coated paper is generally in the range of from about 49 $g \cdot m^{-2}$ to about 65 $g \cdot m^{-2}$. The coating may conveniently be applied by means of a coating machine including a short dwell time coating head, which is a device in which a captive pond of coating composition under a slightly elevated pressure is held in contact with a moving paper web for a time in the range of from 0.0004 second to 0.01 second, before excess coating composition is removed by means of a trailing blade. However, other types of coating apparatus may also be used for preparing lightweight coated paper. LWC paper is generally used for printing magazines, catalogues and advertising or promotional material. The coated paper is required to meet certain standards of surface gloss and smoothness. For example, the paper is generally required to have a gloss value of at least about 32, and up to about 70, TAPPI units, and a Parker Print Surf value in the range of from about 0.5 μm to about 1.6 μm.

Ultra lightweight coated, or ULWC, paper (otherwise known as light lightweight coated, or LLWC, paper) is used for catalogues and for advertising and promotional material sent through the mail to reduce mailing costs. The coating weight is generally in the range of from 5 $g \cdot m^{-2}$ to 7 $g \cdot m^{-2}$ per side. The grammage is generally in the range of from about 35 $g \cdot m^{-2}$ to about 48 $g \cdot m^{-2}$.

A very important white inorganic pigment for use in preparing coating compositions for the manufacture of LWC and ULWC papers is processed particulate kaolin clay. Large deposits of kaolin clay exist in Devon and Cornwall, England and in the States of Georgia and South Carolina, United States of America. Important deposits also occur in Brazil, Australia, and in several other countries. Kaolin clay consists predominantly of the mineral kaolinite, together with small proportions of various impurities. Kaolinite exists in the form of hydrous aluminosilicate crystals in the shape of thin hexagonal plates, but these plates tend to adhere together face-to-face to form stacks. The individual plates may have mean diameters of 1 μm or less, but kaolinite particles in the form of stacks of plates may have an equivalent spherical diameter (esd) of up to 10 μm or more. Generally speaking, kaolin clay particles which have an esd of 2 μm or more are in the form of stacks of kaolinite plates, rather than individual plates.

WO-A-99/51815, the disclosure of which is incorporated herein by reference, describes a paper coating pigment comprising a processed particulate kaolin clay the particles of which (i) have a particle size distribution such that at least 80% by weight of the particles have an esd less than 2 μm and not less than 8% by weight of the particles have an esd less than 0.25 μm and (ii) have a shape factor of at least 45.

It is known to replace part of the processed kaolin clay in a paper coating pigment by particulate calcium carbonate.

Particulate calcium carbonate can be obtained from natural sources or can be manufactured synthetically. Manufactured calcium carbonate is generally obtained by precipitation from aqueous solution. Precipitated calcium carbonate (PCC) is obtained in three different principal crystal forms: the vaterite form, which is thermodynamically unstable, the calcite form which is the most stable and is also the most abundant natural crystalline form, and the aragonite form which is metastable under normal ambient conditions of temperature and pressure, but converts to calcite at elevated temperatures.

The aragonite form typically crystallises as long, thin needles (acicular shape) having a typical length:diameter ratio of about 10:1, but the calcite form exists in several different shapes, of which the most commonly found are: the rhombohedral shape, in which the length and diameter of the crystals are approximately equal and the crystals may be either aggregated or unaggregated; and the scalenodedral shape, in which the crystals are like double, two-pointed pyramids having a typical length:diameter ratio of about 4:1, and which are generally aggregated. All these forms of calcium carbonate can be prepared by carbonation of an aqueous lime-containing medium by suitable variation of the process conditions.

Calcium carbonate can be ground to obtain particulate ground calcium carbonate (GCC), by methods which are well known in the art. GCC particles have a generally spherical form.

Blends of kaolin clay and aragonitic PCC for use in paper coating are known in the art. In the early 1960s, Hagemeyer carried out work on various pigment blends including kaolin/aragonite blends (TAPPI, March 1960, Vol. 43, No. 3, pages 277-288; and TAPPI, February 1964, Vol. 47, No. 2, pages 75-77). Crawshaw et al, 1982 TAPPI Coating Conference Proceedings 143-164 (1982) describes the effect of PCC shape on certain properties of kaolin-PCC paper coating blends. U.S. Pat. No. 5,833,747 (Bleakley et al.) also describes various kaolin clay/aragonite blends in which the aragonite is made by a particular method in which the PCC-containing suspension is at least partially dewatered and subjected to comminution by high shear attrition grinding with an attrition grinding medium. WO-A-00/66509 and WO-A-00/66510 (Lyons et al.) describe various kaolin clay/PCC blends, in which "blocky" kaolin clay is used, by which is stated to mean a shape factor less than 20. The disclosures of all these references are incorporated herein by reference.

BRIEF DESCRIPTION OF THE INVENTION

It has now been found that a paper having improved properties is obtained when the paper is coated with a paper coating composition which includes a pigment comprising a selected particulate processed hydrous kaolin clay and a selected particulate calcium carbonate. Specifically, it has been found that there are synergistic improvements to the gloss, opacity, brightness and smoothness of the paper, or to at least some of those parameters, when compared to papers in which the pigment in the coating is either one of the individual components of the blend.

In accordance with a first aspect of the present invention, there is provided a coating composition for use in producing a gloss coating on paper and other substrates, the composition comprising an aqueous suspension of a particulate pigment together with a binder, wherein the particulate pigment comprises:

(a) a first component which is a precipitated calcium carbonate consisting predominantly of aragonitic or rhombohedral particle shapes or of aragonitic and rhombohedral particle shapes in a weight ratio of between about 40:60 and about 60:40 (e.g. about 50:50) aragonitic: rhombohedral, and a second component which is a processed particulate hydrous kaolin clay having a shape factor greater than or equal to about 25 and a steepness greater than or equal to about 20; or (b) a first component which is a fine particulate calcium carbonate consisting predominantly of particles having a generally spherical particle shape, and a second component which is a processed particulate hydrous kaolin clay having a shape factor greater than or equal to about 45 and a mean equivalent particle diameter ($d_{50}$) less than about 0.5 μm; or (c) a first component which is a precipitated calcium carbonate consisting predominantly of aragonitic and rhombohedral particle shapes in a weight ratio of between about 40:60 and about 60:40 (e.g. about 50:50) aragonitic:rhombohedral, and a second component which is a processed particulate hydrous kaolin clay having a shape factor less than about 25.

The coating composition may optionally include further components, as discussed in more detail below.

The first and second components of the particulate pigment are suitably present in a weight ratio of at least about 10:90 first:second components, preferably above about 40:60, e.g. about 50:50. It is preferred that the weight ratio of the first: second components should not be more than about 80:20, more typically not more than about 75:25 or about 60:40.

The invention also relates to: methods for preparing the coating composition of the present invention; to pigment blends for use in preparing the coating composition; to methods for preparing paper coated with the said coating composition; and to paper coated with the said coating composition.

In one preferred embodiment, the coated paper of the invention is a coated mechanical paper (or groundwood paper), particularly an LWC.

DETAILED DESCRIPTION OF THE INVENTION

The Particulate Pigment—First Component (Calcium Carbonate)

The calcium carbonate component used in the present invention is readily commercially available, or can be prepared by methods well known in the art.

EXAMPLES of commercially available materials include:

Carbonate A. This comprises predominantly aragonitic crystal shapes. The typical particle size distribution is as follows: 96.1% by weight less than 2 μm; 22.4% by weight less than 0.25 μm. The GE Brightness is 94-98 and the $d_{50}$ is 0.3-0.5 μm. Such a material is OptiCalGloss™, available from the applicant.

Carbonate B. This comprises predominantly rhombohedral crystal shapes. The typical particle size distribution is as follows: 98.5% by weight less than 2 μm; 6.9% by weight less than 0.25 μm. The GE Brightness is 95-98 and the $d_{50}$ is 0.5-0.7 μm. Such a material is OptiCalPrint™, available from the applicant.

Carbonate C. This is an ultrafine GCC and comprises predominantly generally spherical particles. The typical particle size distribution is such that: 93% by weight of the particles are less than 2 μm. The GE Brightness is 96.9. Such a material is Carbital 95™, available from the applicant.

Carbonate D. This comprises predominantly aragonitic crystal shapes. The typical particle size distribution is as follows: 99% by weight less than 2 μm; 96% by weight less than 1 μm; 75% by weight less than 0.5 μm; 32% by weight less than 0.25 μm. The ISO powder brightness is 94.3.

Carbonate E. This comprises predominantly rhombohedral crystal and shapes. The typical size distribution is as follows: 98% by weight less than 2 μm; 90% weight less 1 μm; 39% by weight less than 0.5 μm; 6% by weight less than 0.5 μm. The ISO powder brightness is 95.5. Such a material is Albaglos S™, available from SMI.

Carbonate F. This comprises predominantly aragonitic crystal shapes. The typical particle size distribution is as follows: 91% by weight less than 2 μm; 72% by weight less than 1 μm; 58% by weight less than 0.5 μm; 26% by weight less than 0.25 μm. The ISO powder brightness is 94.3.

Carbonate G. This is a lightly ground (65 kWh/t) version of Carbonate F. It comprises predominantly aragonite crystal shapes. The typical particle size distribution is as follows: 96% by weight less than 2 μm; 86% by weight less than 1 μm; 69% by weight less than 0.5 μm; 30% by weight less than 0.25 μm. The ISO powder brightness is 92.5.

Carbonate H. This is a fully ground (180-200 kWh/t) version of Carbonate F.

Carbonate I. This is a predominantly rhombohedral crystal shape. The typical particle size distribution is as follows: 98% by weight less than 2 μm; 89% by weight less than 1 μm; 55% by weight less than 1 μm; 18% by weight less than 0.25 μm. The ISO powder brightness is 95.9. Such a material is Faxe Rhombo (0.5 μm)™, available from Faxe.

Carbonate J. The typical particle size distribution is as follows: 99% by weight less than 2 μm; 96% by weight less than 1 μm; 75% by weight less than the 0.5 μm; 26% by weight less than 0.25 μm. The ISO powder brightness is 93.8. This can be prepared by sand grinding Carbonate F.

Carbonate K. This is a fine GCC and comprises predominantly generally spherical particles. The typical particle size distribution is such that 90% weight of the particles are less than 2 μm and 65% by weight of the particles are less than 1 μm. The brightness is 97 (GE) or 95 (ISO) and the $d_{50}$ is 0.7 μm. Such a material is Carbital 90™, available from the applicant.

Carbonate L. This is a fine GCC and comprises predominantly generally spherical particles. The typical size distribution is such that 97-99% by weight of the particles are less than 2 μm; and 87-90% by weight are less than 1 μm. The brightness is 96 (GE) or 94 (ISO) and the $d_{50}$ is 0.4 μm. Such a material is Carbilux™, available from the applicant.

Carbonate M. This is a ground aragonitic PCC. It comprises predominantly aragonite crystal shapes. The typical particle size distribution is as follows: 98% by weight less than 2 μm; 94% by weight less than 1 μm; 75% by weight less than 0.5 μm; 30% by weight less than 0.25 μm. The ISO powder brightness is 93.7.

The methods for preparing PCC generally comprise precipitation using (i) lime and carbon dioxide, (ii) lime and soda or (iii) the Solvay process. A preferred method for preparing aragonitic or rhombohedral PCC uses the first method, and includes the step of carbonating an aqueous lime-containing medium to produce an aqueous suspension of a PCC. The process conditions during the precipitation process required generally to achieve predominantly a preferred crystal form are well known to those skilled in the art.

For example, predominantly the aragonitic crystal form is precipitated when the aqueous lime-containing medium is prepared by mixing quicklime with water at a temperature not exceeding 60 degrees Celsius to give an aqueous suspension containing from 0.5 to 3.0 moles of calcium hydroxide per litre of suspension under conditions such that the temperature of the suspension increases by not more than 80 Celsius degrees, and cooling the resultant suspension of slaked lime to a temperature in the range from 30 to 50 degrees Celsius, and when the subsequent carbonation involves passing a carbon dioxide containing gas through the cooled suspension at a rate such that not more than 0.02 moles of carbon dioxide are supplied per minute per mole of calcium hydroxide to precipitate calcium carbonate in the suspension, while the temperature thereof is maintained within the range from 30 to 50 degrees Celsius until the pH has fallen to a value within the range from 7.0 to 7.5.

The precipitate product in the form of an aqueous suspension preferably has a viscosity of not more than 500 mPa·s (as measured by a Brookfield Viscometer using a spindle speed of 100 rpm) and is preferably a pumpable and flowable slurry.

The aqueous suspension containing the precipitate product initially formed may be treated so as to separate partially or fully the aqueous host medium from the precipitate product solids, e.g. using conventional separation processes. For example, processes such as filtration, sedimentation, centrifugation or evaporation may be used. Filtration using a filter press is preferred. The separated aqueous medium (e.g. water) may—optionally with further purification or clarification by one or more chemical, biochemical or mechanical processes which may be known per se—be recycled for reuse, e.g. in a paper mill (for example, for use in diluting the paper-making stock or for use as showers for washing machinery). The separated solids may be assessed for quality control by measurements taken on samples and subsequently delivered to a storage tank and thereafter supplied as necessary for use in a user application, e.g. in the present invention. The solids containing suspension may be re-diluted for use at the user plant.

It is not necessary for an aqueous suspension containing a PCC product to be dewatered prior to supply for use in a user application, e.g. for use in a paper mill.

The aqueous suspension or slurry may be delivered to a storage tank or directly to the user plant without substantial dewatering.

The PCC typically has a $d_{50}$ of less than about 0.8 μm, for example less than about 0.7 μm, and suitably at least about 0.2 μm, e.g. between about 0.25 μm and about 0.45 μm.

The calcium carbonate component of the pigment products according to the present invention preferably has a particle size distribution such that at least about 90% by weight of the particles have an esd less than 2 μm. As used herein the parameter esd is measured in a well known manner by sedimentation of the particulate material in a fully dispersed condition in an aqueous medium using a Sedigraph 5100 machine as supplied by Micromeritics Instruments Corporation, Norcross, Ga., USA (telephone: +1 770 662 3620; website: www.micromeritics.com), referred to herein as a "Micromeritics Sedigraph 5100 unit". Such a machine provides measurements and a plot of the cumulative percentage by weight of particles having an esd less than given esd values.

The PCC employed in the present invention may, if predominantly aragonite, have in the fully dispersed state a particle size distribution such that the percentage P by weight of particles having a size less than xμm, where x is respectively 2 μm, 1 μm, 0.5 μm and 0.25 μm is as follows:

| x (μm) | P (%) |
|---|---|
| 2 | At least 90 |
| 1 | At least 75 |
| 0.5 | At least 60 |
| 0.25 | Between 15 and 40 |

e.g. the PCC employed in the present invention may have the particle size distribution as follows:

| x (μm) | P (%) |
|---|---|
| 2 | at least 95 |
| 1 | at least 82 |
| 0.5 | at least 66 |
| 0.25 | between 23 and 33 |

Alternatively, the PCC employed in the compositions of the present invention may, if predominantly rhombohedral, have in the fully dispersed state a particle size distribution such that the percentage P by weight of particles having a size less than xμm, where x is respectively 2 μm, 1 μm, 0.5 μm and 0.25 μm, is as follows:

| X (μm) | P (%) |
|---|---|
| 2 | at least 93 |
| 1 | at least 86 |
| 0.5 | at least 22 |
| 0.25 | Between 5 and 25 |

e.g. the PCC employed in the compositions of the present invention may have the particle size distribution as follows (x and P as defined above):

| X (μm) | P (%) |
|---|---|
| 2 | at least 97 |
| 1 | at least 90 |
| 0.5 | at least 25 |
| 0.25 | between 6 and 19 |

The median equivalent particle diameter of such a rhombohedral PCC may be from about 0.4 to about 0.6 μm.

The PCC employed in the compositions of the invention may have a GE powder brightness of at least 90, e.g. at least 92.

The crystal PCC form achieved in practice is unlikely to be 100% of any selected form. It is quite usual for one crystal form even when predominant to be mixed with other forms. Typically, it might be expected that over 50% by weight of the particles are of the selected form, for example over about 60% by weight, more preferably at least about 80% by weight. Such mixed forms will generally give suitable product properties. The expression "predominantly", when used in reference to the particle shapes or crystal forms, shall be understood in this way, so that, for example a PCC which is described as "predominantly aragonitic" may also include up to 50% by weight of one or more other particle shapes or crystal forms, e.g. rhombohedral.

In the present invention, the aragonite crystal form is generally preferred.

Where a mixture of aragonitic and rhombohedral crystal shapes is required according to the present invention, this may be prepared by conventional mixing techniques.

Fine spherical calcium carbonate (ground calcium carbonate or GCC) is produced from natural or precipitated calcium carbonate by grinding methods which are well known in the art. The expression "fine" used herein refers to products in which at least about 80% by weight of the particles have an esd less than 2 μm, and therefore encompasses the art term "ultrafine".

The Particulate Pigment—Second Component (Processed Kaolin Clay)

As discussed in more detail below, the processed kaolin clay component used in the present invention is readily commercially available, or can be prepared by methods well known in the art. The kaolin clay component employed in the compositions of the present invention may suitably be a kaolin having a high brightness, e.g. a GE powder brightness of at least 85, e.g. at least 90.

Shape Factor of the Kaolin Clay

A particulate kaolin clay of high shape factor is considered to be more "platey" than a kaolin product of low shape factor. "Shape factor" as used herein is a measure of an average value (on a weight average basis) of the ratio of mean particle diameter to particle thickness for a population of particles of varying size and shape as measured using the electrical conductivity method and apparatus described in GB-A-2240398/U.S. Pat. No. 5,128,606/EP-A-0528078 and using the equations derived in these patent specifications. "Mean particle diameter" is defined as the diameter of a circle which has the same area as the largest face of the particle. In the measurement method described in EP-A-0528078 the electrical conductivity of a fully dispersed aqueous suspension of the particles under test is caused to flow through an elongated tube. Measurements of the electrical conductivity are taken between (a) a pair of electrodes separated from one another along the longitudinal axis of the tube, and (b) a pair of electrodes separated from one another across the transverse width of the tube, and using the difference between the two conductivity measurements the shape factor of the particulate material under test is determined.

As stated above, the shape factor of the particulate kaolin clays used in the present invention may be greater than, equal to, or less than about 25, or may be greater than or equal to about 45, depending on the nature of the first component of the coating composition. Where the shape factor is above about 25, it may preferably be above about 30, more preferably above about 35. Where the shape factor is below about 25, it may preferably be between about 5 and about 20.

Mean Equivalent Particle Diameter of the Kaolin Clay

The mean (average) equivalent particle diameter ($d_{50}$ value) and other particle size properties referred to herein for the particulate kaolin clays are as measured by sedimentation of the particulate material in a fully dispersed condition in an aqueous medium using a Micromeritics Sedigraph 5100 unit. The mean equivalent particle size $d_{50}$ is the value determined in this way of the particle esd at which there are 50% by weight of the particles which have an equivalent spherical diameter less than that $d_{50}$ value.

The value of $d_{50}$ for the particulate kaolin clays used in the present invention may be less than, equal to or greater than about 0.5 μm, depending on the nature of the first component. Where the $d_{50}$ for the particulate kaolin clay is greater than or equal to about 0.5 μm, it may suitably be in the range from about 0.5 μm to about 1.5 μm. Where the $d_{50}$ for the particulate kaolin is less than or equal to about 0.5 μm, it may suitably be in the range from about 0.1 μm to about 0.5 μm.

Where the kaolin clay to be used has a shape factor less than about 25, it is preferred that the clay will have a $d_{50}$ less than about 0.5 μm, for example in the range about 0.1 μm to about 0.3 μm.

Steepness of the Kaolin Clay

The "steepness" of a particulate kaolin clay refers to a parameter of the particle size distribution of the kaolin, defined as $d_{30}/d_{70}\times100$, where $d_{30}$ is the value of the particle esd at which there are 30% by weight of the particles which have an equivalent spherical diameter less than that $d_{30}$ value and $d_{70}$ is the value of the particle esd at which there are 70% by weight of the particles which have an equivalent spherical diameter less than that $d_{70}$ value.

The steepness of the particulate kaolin clay used in the present invention is less than, equal to or greater than about 20, depending on the nature of the first component. Where the steepness of the particulate kaolin clay is greater than about 20, it may preferably be between about 25 and about 45, e.g. between about 35 and about 45, and typically less than about 40.

Preparation of the Kaolin Clay

The particulate kaolin clay used in this invention is a processed material derived from a natural source, namely raw natural kaolin clay mineral. The processed kaolin clay may typically contain at least 50% by weight kaolinite. For example, most commercially important processed kaolin clays contain greater than 75% by weight kaolinite and may contain greater than 90%, in some cases greater than 95% by weight of kaolinite.

The processed kaolin clay used in the present invention may be prepared from the raw natural kaolin clay mineral by one or more other processes which are well known to those skilled in the art, for example by known refining or beneficiation steps.

For example, the clay mineral may be bleached with a reductive bleaching agent, such as sodium hydrosulfite. If sodium hydrosulfite is used, the bleached clay mineral may optionally be dewatered, and optionally washed and again optionally dewatered, after the sodium hydrosulfite bleaching step.

The clay mineral may be treated to remove impurities, e.g. by flocculation or magnetic separation techniques well known in the art.

The process for preparing the particulate kaolin clay used in the present invention may also include one or more comminution steps, e.g. grinding or milling. Light comminution of a coarse kaolin is used to give suitable delamination thereof.

The comminution may be carried out by use of beads or granules of a plastics, e.g. nylon, grinding or milling aid. The coarse kaolin may be refined to remove impurities and improve physical properties using well known procedures. The kaolin clay may be treated by a known particle size classification procedure, e.g. screening and/or centrifuging, to obtain particles having a desired $d_{50}$ value or particle size distribution.

Examples of Kaolin Clays

A number of particulate kaolin clays are commercially available, which have the required particle size and shape factor. Alternatively, the particulate kaolin clays used in the present invention can easily be prepared from commercially available kaolin clays, in ways well known to the skilled worker, to arrive at the required particle size and shape factor.

The following particulate processed hydrous kaolin clays for use in the present invention may be mentioned. They are used in the Examples below:

Clay A. This has a shape factor of approximately 25 to 35, a $d_{50}$ of 0.58 μm and a steepness of 27. The typical particle size distribution is as follows: 83% by weight less than 2 μm; 66% by weight less than 1 μm; 47% by weight less than 0.5 μm; 24% by weight less than 0.25 μm. The GE Brightness is 88.9. Such a clay is marketed by the applicant as Astraplate™.

Clay B. This has a shape factor of approximately 33, a $d_{50}$ of 0.41 μm and a steepness of 36. The typical particle size distribution is as follows: 94% by weight less than 2 μm; 82% by weight less than 1 μm; 60% by weight less than 0.5 μm; 30% by weight less than 0.25 μm. The ISO Brightness is 86.8.

Clay C. This has a shape factor of approximately 33, a $d_{50}$ of 0.62 μm and a steepness of 43. The typical particle size distribution is as follows: 92% by weight less than 2 μm; 73% by weight less than 1 μm; 38% by weight less than 0.5 μm; 14% by weight less than 0.25 μm. The ISO Brightness is 89.1. Such a clay is marketed by the applicant as Supraprint™.

Clay D. This has a shape factor of approximately 56, a $d_{50}$ of 0.41 μm and a steepness of 32. The typical particle size distribution is as follows: 92% by weight less than 2 μm; 78.5% by weight less than 1 μm; 59% by weight less than 0.5 μm; 31% by weight less than 0.25 μm. The GE Brightness is 88.2. Such a clay is marketed by the applicant as Contour 1500™.

Clay E. This has a shape factor of approximately 58, a $d_{50}$ of 0.46 μm and a steepness of 36. The typical particle size distribution is as follows: 92% by weight less than 2 μm; 78% by weight less than 1 μm; 55.5% by weight less than 0.5 μm; 24.5% by weight less than 0.25 μm. The GE Brightness is 88.4.

Clay F. This has a shape factor of approximately 25, a $d_{50}$ of 0.49 μm and a steepness of 24.4. The typical particle size distribution is as follows: 82% by weight less than 2 μm; 68% by weight less than 1 μm; 50% by weight less than 0.5 μm; 27% by weight less than 0.25 μm. The GE Brightness is 88.1.

Clay G. This has a shape factor of approximately 25-30, a $d_{50}$ of 0.44 μm and a steepness of 36. The typical particle size distribution is as follows: 93% by weight less than 2 μm; 80% by weight less than 1 μm; 56% by weight less than 0.5 μm; 27% by weight less than 0.25 μm. The GE Brightness is 87.0. Such a clay is marketed by the applicant as Supragloss 95™.

Clay H. This has a shape factor of approximately 25-30, a $d_{50}$ of 0.45 μm and a steepness of 30. The typical particle size distribution is as follows: 90% by weight less than 2 μm; 76% by weight less than 1 μm; 54% by weight less than 0.5 μm; 30% by weight less than 0.25 μm. The GE Brightness is 87.0.

Clay I. This is a "blocky" (low shape factor) paper coating kaolin pigment. This has a shape factor of approximately 12, a $d_{50}$ of 0.53 μm and a steepness of 47. The typical particle size distribution is as follows: 95.6% by weight less than 2 μm; 20.5% by weight less than 0.25 μm. The GE Brightness is 89.6. Such a clay is marketed by the applicant as Astra-Plus™.

Clay J. This is a "blocky" (low shape factor) paper coating kaolin pigment. This has a shape factor of approximately 11, a $d_{50}$ of 0.18 μm and a steepness of 36.9. The typical particle size distribution is as follows: 99% by weight less than 2 μm; 98% by weight less than 1 μm; 92% by weight less than 0.5 μm; 65% by weight less than 0.25 μm. The GE Brightness is 91.3. Such a clay is marketed by Huber as Hubertex 91™.

Clay K. This is a "blocky" (low shape factor) paper coating kaolin pigment. This has a shape factor of approximately 7.8, a $d_{50}$ of 0.26 μm and a steepness of 37.3. The typical particle size distribution is as follows: 100% by weight less than 2 μm; 99% by weight less than 1 μm; 89% by weight less than 0.5 μm; 51% by weight less than 1 μm. The GE Brightness is 87.7. Such a clay is marketed by Cadam SA (Brazil) as Amazon 88™.

The Binder

The binder of the composition according to the present invention may be selected from binders which are well known in the art. The binder may form from 4% to 30%, e.g. 8% to 20%, especially 8% to 15%, by weight of the solids content of the composition. The amount employed will depend upon the composition and the type of binder, which may itself incorporate one or more ingredients.

Examples of suitable binders include:

(a) starch: levels typically range from about 4% by weight to about 20% by weight. The starch may suitably be derived from a natural starch, e.g. natural starch obtained from a known plant source, for example, wheat, maize, potato or tapioca. Where starch is employed as a binder ingredient, the starch may suitably be modified by one or more chemical treatments known in the art. The starch may, for example, be oxidised to convert some of its —$CH_2OH$ groups to —COOH groups. In some cases the starch may have a small proportion of acetyl, —$COCH_3$, groups. Alternatively, the starch may be chemically treated to render it cationic or amphoteric, i.e. with both cationic and anionic charges. The starch may also be converted to a starch ether, or hydroxyalkylated starch by replacing some —OH groups with, for example, —$O.CH_2.CH_2OH$ groups, —$O.CH_2.CH_3$ groups or —$O.CH_2.CH_2.CH_2OH$ groups. A further class of chemically treated starches which may be used is that known as the starch phosphates. Alternatively, the raw starch may be hydrolysed by means of a dilute acid or an enzyme to produce a gum of the dextrin type. The amount of the starch binder used in the composition according to the present invention is preferably from about 4% to about 25% by weight, based on the dry weight of pigment. The starch binder may be used in conjunction with one or more other binders, for example synthetic binders of the latex or polyvinyl acetate or polyvinyl alcohol type. When the starch binder is used in conjunction with another binder, e.g. a synthetic binder, the amount of the starch binder is preferably from about 2% to about 20% by weight, and the amount of the synthetic binder from about 2% to about 12% by weight, both based on the weight of dry pigment. Preferably, at least about 50% by weight of the binder mixture comprises modified or unmodified starch.

(b) latex: levels typically range from about 4% by weight to about 20% by weight. The latex may comprise for example a styrene butadiene rubber latex, acrylic polymer latex, polyvinyl acetate latex, or styrene acrylic copolymer latex.

(c) other binders: levels typically again range from about 4% by weight to about 20% by weight. Examples of other binders include proteinaceous adhesives such as, for example, casein or soy protein; polyvinyl alcohol.

Any of the above binders and binder types may be used alone or in admixture with each other and/or with other binders, if desired.

Optional Additional Components of the Composition

The coating composition according to the present invention may contain one or more optional additional components, if desired. Such additional components, where present, are suitably selected from known additives for paper coating compositions. Examples of known classes of optional additive are as follows:

(a) one or more cross linkers: e.g. in levels of up to about 5% by weight; for example glyoxals, melamine formaldehyde resins, ammonium zirconium carbonates.

(b) one or more water retention aids: e.g. in up to about 2% by weight, for example sodium carboxymethyl cellulose, hydroxyethyl cellulose, PVOH (polyvinyl alcohol), starches, proteins, polyacrylates, gums, alginates, polyacrylamide bentonite and other commercially available products sold for such applications.

(c) one or more viscosity modifiers and/or thickeners: e.g. in levels up to about 2% by weight; for example acrylic associative thickeners, polyacrylates, emulsion copolymers, dicyanamide, triols, polyoxyethylene ether, urea, sulphated castor oil, polyvinyl pyrrolidone, CMC (carboxymethyl celluloses, for example sodium carboxymethyl cellulose), sodium alginate, xanthan gum, sodium silicate, acrylic acid copolymers, HMC (hydroxymethyl celluloses), HEC (hydroxyethyl celluloses) and others.

(d) one or more lubricity/calendering aids: e.g. in levels up to about 2% by weight, for example calcium stearate, ammonium stearate, zinc stearate, wax emulsions, waxes, alkyl ketene dimer, glycols.

(e) one or more dispersants: e.g. in levels up to about 2% by weight, for example polyelectrolytes such as polyacrylates and copolymers containing polyacrylate species, especially polyacrylate salts (eg sodium and aluminium optionally with a group II metal salt), sodium hexametaphosphates, non-ionic polyol, polyphosphoric acid, condensed sodium phosphate, non-ionic surfactants, alkanolamine and other reagents commonly used for this function.

(f) one or more antifoamers/defoamers: e.g. in levels up to about 1% by weight, for example blends of surfactants, tributyl phosphate, fatty polyoxyethylene esters plus fatty alcohols, fatty acid soaps, silicone emulsions and other silicone containing compositions, waxes and inorganic particulates in mineral oil, blends of emulsified hydrocarbons and other compounds sold commercially to carry out this function.

(g) one or more dry or wet pick improvement additives: e.g. in levels up to about 2% by weight, for example melamine resin, polyethylene emulsions, urea formaldehyde, melamine formaldehyde, polyamide, calcium stearate, styrene maleic anhydride and others.

(h) one or more dry or wet rub improvement and/or abrasion resistance additives: e.g. in levels up to about 2% by weight, for example glyoxal based resins, oxidised polyethylenes, melamine resins, urea formaldehyde, melamine formaldehyde, polyethylene wax, calcium stearate and others.

(i) one or more gloss-ink hold-out additives: e.g. in levels up to about 2% by weight, for example oxidised polyethylenes, polyethylene emulsions, waxes, casein, guar gum, CMC, HMC, calcium stearate, ammonium stearate, sodium alginate and others.

(j) one or more optical brightening agents (OBA) and/or fluorescent whitening agents (FWA): e.g. in levels up to about 1% by weight, for example stilbene derivatives.

(k) one or more dyes: e.g. in levels up to about 0.5% by weight.

(l) one or more biocides/spoilage control agents: e.g. in levels up to about 1% by weight, for example metaborate, sodium dodecylbenene sulphonate, thiocyanate, organosulphur, sodium benzonate and other compounds sold commercially for this function e.g. the range of biocide polymers sold by Nalco.

(m) one or more levelling and evening aids: e.g. in levels up to about 2% by weight, for example non-ionic polyol, polyethylene emulsions, fatty acid, esters and alcohol derivatives, alcohol/ethylene oxide, sodium CMC, HEC, alginates, calcium stearate and other compounds sold commercially for this function.

(n) one or more grease and oil resistance additives: e.g. in levels up to about 2% by weight, e.g. oxidised polyethylenes, latex, SMA (styrene maleic anhydride), polyamide, waxes, alginate, protein, CMC, HMC.

(o) one or more water resistance additives: e.g. in levels up to about 2% by weight, e.g. oxidised polyethylenes, ketone resin, anionic latex, polyurethane, SMA, glyoxal, melamine resin, urea formaldehyde, melamine formaldehyde, polyamide, glyoxals, stearates and other materials commercially available for this function.

(p) one or more additional pigments: The pigment used in the present invention, namely the calcium carbonate and kaolin clay system, may be used as the sole pigment in the paper coating compositions, or it may be used in conjunction with one or more other known pigments, such as for example, calcined kaolin, titanium dioxide, calcium sulphate, satin white, talc and so called 'plastic pigment'. When a mixture of pigments is used the calcium carbonate and kaolin clay system is preferably present in the composition in an amount of at least about 80% of the total dry weight of the mixed pigments.

Any of the above additives and additive types may be used alone or in admixture with each other and/or with other additives, if desired.

For all of the above additives, the percentages by weight quoted are based on the dry weight of pigment (100%) present in the composition. Where the additive is present in a minimum amount the minimum amount may be about 0.01% by weight based on the dry weight of pigment.

The Coating Composition

The coating composition according to the present invention comprises an aqueous suspension of the defined particulate pigment together with the binder and optionally one or more further additive components, as discussed above.

The coating compositions according to the present invention preferably consist essentially of an aqueous suspension of the defined particulate pigment, the binder and optionally one or more further additive selected from the list of additive types given above, with less than about 10% by weight of other ingredients.

The solids content of the paper coating composition according to the present invention may be greater than about 60% by weight, preferably at least about 70%, preferably as high as possible but still giving a suitably fluid composition which may be used in coating (e.g. up to about 80%).

Preparation of the Composition

According to a second aspect of the present invention, there is provided a method for preparing the coating composition of the invention, which method comprises mixing the particulate pigment and the binder in an aqueous liquid medium to prepare a suspension of the solid components therein. The coating composition may suitably be prepared by conventional mixing techniques, as will be well known to one of ordinary skill in this art.

A pigment mixture may initially be formed by mixing aqueous suspensions of each of the required pigments to form an aqueous suspension incorporating the mixture of pigments. Such an aqueous suspension may be a dispersed aqueous suspension and the individual aqueous suspensions of pigments employed to form the mixture may each incorporate a dispersing agent. The dispersing agents employed to disperse the pigments in the individual aqueous suspensions mixed together, and the concentrations of such suspensions, may be the same or different.

The paper coating composition may be formed by mixing together an aqueous dispersed suspension containing the pigment components, with the binder and any other optional additional constituents, in a manner familiar to those skilled in the art.

Pigment Blends

According to a third aspect of the present invention, there is provided a pigment composition for use in preparing the coating composition of the invention, the pigment composition comprising a mixture of particulate materials consisting of or including:

binder, wherein the particulate pigment comprises:

(a) a first component which is a precipitated calcium carbonate consisting predominantly of aragonitic or rbombohedral particle shapes or of aragonitic and rhombohedral particle shapes in a weight ratio of between about 40:60 and about 60:40 (e.g. about 50:50) aragonitic: rhombohedral, and a second component which is a processed particulate hydrous kaolin clay having a shape factor greater than or equal to about 25 and a steepness greater than or equal to about 20; or (b) a first component which is a fine particulate calcium carbonate consisting predominantly of particles having a generally spherical particle shape, and a second component which is a processed particulate hydrous kaolin clay having a shape factor greater than or equal to about 45 and a mean equivalent particle diameter ($d_{50}$) less than about 0.5 μm; or (c) a first component which is a precipitated calcium carbonate consisting predominantly of aragonitic and rhombohedral particle shapes in a weight ratio of between about 40:60 and about 60:40 (e.g. about 50:50) aragonitic:rhombohedral, and a second component which is a processed particulate hydrous kaolin clay having a shape factor less than about 25.

The pigment composition may be provided as a dry particulate mixture consisting of or including the components defined above, or as a suspension of the particles in a liquid, suitably aqueous, medium.

Paper Coating Process

According to a further aspect of the present invention, there is provided a method of use of the coating composition, which comprises applying the composition to coat a sheet of paper and calendering the paper to form a gloss coating thereon. Preferably, the gloss coating is formed on both sides of the paper.

Calendering is a well known process in which paper smoothness and gloss is improved and bulk is reduced by passing a coated paper sheet between calender nips or rollers one or more times. Usually, elastomer coated rolls are employed to give pressing of high solids compositions. An elevated temperature may be applied. One or more (e.g. up to about 12, or sometimes higher) passes through the nips may be applied.

Methods of coating paper and other sheet materials, and apparatus for performing the methods, are widely published and well known. Such known methods and apparatus may conveniently be used for preparing coated paper according to the present invention. For example, there is a review of such methods published in Pulp and Paper International, May. 1994, page 18 et seq. Sheets may be coated on the sheet forming machine, i.e. "on-machine", or "off-machine" on a coater or coating machine. Use of high solids compositions is desirable in the coating method because it leaves less water to evaporate subsequently. However, as is well known in the art, the solids level should not be so high that high viscosity and levelling problems are introduced.

The methods of coating according to the present invention are preferably performed using apparatus comprising (i) a means of applying the coating composition to the material to be coated, viz an applicator; and (ii) a means for ensuring that a correct level of coating composition is applied, viz a metering device. When an excess of coating composition is applied to the applicator, the metering device is downstream of it. Alternatively, the correct amount of coating composition may be applied to the applicator by the metering device, e.g. as a film press. At the points of coating application and metering, the paper web support ranges from a backing roll, e.g. via one or two applicators, to nothing (i.e.: just tension). The time the coating is in contact with the paper before the excess is finally removed is the dwell time—and this may be short, long or variable.

The coating is usually added by a coating head at a coating station. According to the quality desired, paper grades are uncoated, single coated, double coated and even triple coated. When providing more than one coat, the initial coat (precoat) may have a cheaper formulation and optionally less pigment in the coating composition. A coater that is applying a double coating, i.e. a coating on each side of the paper, will have two or four coating heads, depending on the number of sides coated by each head. Most coating heads coat only one side at a time, but some roll coaters (e.g. film press, gate roll, size press) coat both sides in one pass.

Examples of known coaters which may be employed include, without limitation, air knife coaters, blade coaters, rod coaters, bar coaters, multi-head coaters, roll coaters, roll/blade coaters, cast coaters, laboratory coaters, gravure coaters, kiss coaters, liquid application systems, reverse roll coaters, curtain coaters, spray coaters and extrusion coaters.

In all examples of coating compositions described in this specification, water is added to the solids to give a concentration of solids which is preferably such that, when the composition is coated onto a sheet to a desired target coating weight, the composition has a rheology which is suitable to enable the composition to be coated with a pressure (e.g. a blade pressure) of between 1 and 1.5 bar.

Coated Paper Product

According to a further aspect of the present invention, there is provided a paper coated with a gloss coating which is the dry residue of a paper coating composition according to the present invention.

The paper, after coating and calendering, may typically have a total weight per unit area (grammage) in the range from 30 $g \cdot m^{-2}$ to 70 $g \cdot m^{-2}$, especially from 49 $g \cdot m^{-2}$ to 65 $g \cdot m^{-2}$ or 35 $g \cdot m^{-2}$ to 48 $g \cdot m^{-2}$. The final coating preferably has a weight per unit area (coating weight) in the range from 3 $g \cdot m^{-2}$ to 20 $g \cdot m^{-2}$, especially from 5 $g \cdot m^{-2}$ to 13 $g \cdot m^{-2}$. Such a coating may be applied to both sides of the paper. Thus, the coated paper may be LWC or ULWC paper. The paper gloss is preferably greater than about 45 TAPPI units and the Parker Print Surf value at a pressure of 1 MPa of each paper coating is preferably less than about 1 μm.

In general, the advantages of the coating composition of the present invention are found at all conventional coating weights. However, in some cases it may be found that different combinations of advantages may be observed at different coating weights. For example, when the particulate kaolin clay has a relatively high shape factor, simultaneously with a relatively low mean equivalent particle diameter and relatively high steepness, the advantages are found in some cases to be more pronounced at higher coating weights.

Test Methods

Gloss

The gloss of a coated paper surface may be measured by means of a test laid down in TAPPI Standard No 480 ts-65. The intensity of light reflected at an angle from the surface of the paper is measured and compared with a standard of known gloss value. The beams of incident and reflected light are both at an angle of 75° to the normal to the paper surface. The results are expressed in TAPPI gloss units. The gloss of the coated paper according to the present invention may be greater than 50, in some cases greater than 55, TAPPI units.

Smoothness

The Parker Print Surf ("PPS") test provides a measure of the smoothness of a paper surface, and comprises measuring the rate at which air under pressure leaks from a sample of the coated paper which is clamped, under a known standard force, between an upper plate which incorporates an outlet for the compressed air and a lower plate, the upper surface of which is covered with a sheet of either a soft or a hard reference supporting material according to the nature of the paper under test. From the rate of escape of the air, a root mean cube gap in μm between the paper surface and the reference material is calculated. A smaller value of this gap represents a higher degree of smoothness of the surface of the paper under test.

Opacity

Opacity, as used herein, is a measure of percent reflectance of incident light off a coated substrate. The standard test method is ISO 2471. The opacity of a sample of paper can be measured by means of an Elrepho Datacolor 3300 spectrophotometer using a wavelength appropriate to opacity measurement. First, a measurement of the percentage of the incident light reflected is made with a stack of at least ten sheets of paper over a black cavity (Rinfinity). The stack of sheets is then replaced with a single sheet of paper, and a second measurement of the percentage reflectance of the single sheet on the black cover is made (R). The percentage opacity is then calculated from the formula:

$$\text{Percentage opacity} = 100 \times R/R\text{infinity}.$$

Brightness

The ISO brightness of the coated paper was measured by means of an Elrepho Datacolour 2000™ brightness meter fitted with a No 8 filter (457 nm wavelength). The GE Brightness, as expressed herein, is defined in TAPPI Standard T452 and refers to the percentage reflectance to light of a 457 nm wavelength according to methods well known to those of ordinary skill in the art.

Print Gloss

The print gloss of a coated paper surface is measured through the following standard TAPPI test. The intensity of light reflected at an angle from the surface of the paper is measured and compared with a standard known print gloss value. The beams of incident and reflected light are both at an angle of 20 degrees or 75 degrees to the normal to the paper surface. The results are expressed in TAPPI print gloss units.

DESCRIPTION OF THE EXAMPLES

Embodiments of the present invention will now be described, without limitation, with reference to the following illustrative Examples.

Example 1

In this example, the properties of compositions according to the invention in which the particulate pigment comprises an aragonite precipitated calcium carbonate and a kaolin clay having a shape factor greater than or equal to 25 and a steepness between 20 and 35, were measured in comparison to compositions including single-component pigments, compositions including a blocky paper coating kaolin clay and compositions including having a generally spherical particle shape (Carbonate C) or rhombohedral PCC (Carbonate B).

A range of aqueous coating compositions was prepared at about 54% or 58% solids (see Table 1 for details), the solids portion comprising as follows:

100 parts total pigment (calcium carbonate/kaolin)
- 8 pph starch (PG280)
- 8 pph styrene-butadiene rubber latex (Dow)
- Acrylic associative thickener as required
- 1 pph Nopcote C104 (calcium stearate).

The pigments used were:

100% Clay A (Control)
50:50 Clay A:Carbonate B ("OC-Print")
50:50 Clay A:Carbonate A ("OC-Gloss")
50:50 Clay A:Carbonate C ("C-95")
100% Clay I (Control)
50:50 Clay I:OC-Print
50:50 Clay I:OC-Gloss
50:50 Clay I:C-95
100% OC-Print
100% OC-Gloss
100% C-95

Coatings were then applied to a 34.5 $g/m^2$ mechanical base paper. A 7.0 $g/m^2$ coatweight was targeted using the Helicoater™ 2000 with a three-inch pond head set at a 50° blade angle. The machine speed was 800 m $min^{-1}$. All the colours were coated at constant solids with Brookfield viscosity adjusted by adjusting the thickener (on average, a dose of ca. 0.05 pph was required). The coating colour viscosities achieved with the different pigments are shown in Table 1 below. A range of coat weights between 5 and 10 $gm^{-2}$ were obtained and properties interpolated to 7.0 $gm^{-2}$.

Calendering conditions were as follows:

Instrument: Beloit Supercalender (chrome plated steel roll/cotton roll)

Calendering Pressure: 250 psi (1.7 MPa)

Nips: 3 nips

Temperature: 60° C.

TABLE 1

Coating Colour Viscosities for Offset

| Pigments | Brookfield mPa · s @ 100 rpm | Hercules 4400 rpm Apparent Viscosity mPa · s | % Solids |
|---|---|---|---|
| 100 Clay A | 1008 | 50.8 | 58.2 |
| 50 Clay A: 50 OC-Print | 1044 | 57.8 | 58.1 |
| 50 Clay A: 50 OC-Gloss | 1080 | 50.8 | 58.2 |
| 50 Clay A: 50 C-95 | 1004 | 49.1 | 54.4 |
| 100 Clay I | 1084 | 68.3 | 58.2 |
| 50 Clay I: 50 OC-Print | 1072 | 58.6 | 58.1 |
| 50 Clay I: 50 OC-Gloss | 1072 | 46.1 | 58.0 |
| 50 Clay I: 50 C-95 | 1052 | 50.6 | 58.2 |
| 100 OC-Print | 1056 | 41.6 | 58.3 |
| 100 OC-Gloss | 1064 | 32.1 | 58.1 |
| 100 C-95 | 1044 | 38.7 | 58.1 |

Results

The sheet properties of gloss, brightness, opacity and PPS smoothness are shown in Tables 2 (100% pigments) and 3 (50:50 mixtures). In all the results, the measured properties interpolated to 7.0 $gm^{-2}$ are shown first, followed by the arithmetic mean of the 100% components (in brackets), finally the positive or negative synergy obtained. Note that positive values represent synergistic improvements in sheet quality and negative values a deterioration in sheet quality.

Using Clay A, brightness and smoothness show synergistic benefits when blended with all three calcium carbonate types. At 50% calcium carbonate, aragonite (OptiCalGloss) is the best choice giving significantly improved gloss (+3 TAPPI units) along with good brightness and opacity gains. Carbital 95 gives no significant improvement in gloss and opacity.

Blends with Astra-Plus (Clay I) behave differently to Clay A. There are antisynergies in gloss with all three carbonate types. Aragonite (OCGloss) gives antisynergy also in opacity and smoothness, and no gain in brghtness. With the rhombic PCC and GCC, only small synergies in brightness and smoothness are observed.

TABLE 2

Sheet properties of 100% pigment coatings interpolated to 7.0 $gm^{-2}$ coat weight

| Sheet property | Clay A | Clay I | OptiCal Gloss | OptiCal Print | Carbital 95 |
|---|---|---|---|---|---|
| 75° Gloss | 44 | 55 | 44 | 40 | 27 |
| Brightness | 65.7 | 68.0 | 69.6 | 69.8 | 67.5 |
| Opacity | 87.0 | 88.0 | 88.1 | 88.0 | 86.7 |
| PPS Smoothness | 1.37 | 1.17 | 1.54 | 1.55 | 1.86 |

TABLE 3

Sheet properties of 50/50 blends, arithmetic means and synergy obtained

| Sheet property | Clay A/OCGloss 50/50 | Clay A/OCPrint 50/50 | Clay A/C-95 50/50 |
|---|---|---|---|
| 75° Gloss | 47 (44) +3 | 42 (42) 0 | 34 (35) −1 |
| Brightness | 68.7 (67.7) +1.0 | 68.6 (67.8) +0.8 | 67.6 (66.6) +1.0 |
| Opacity | 87.9 (87.6) +0.3 | 87.9 (87.5) −0.4 | 87.2 (86.9) −0.3 |
| PPS Smoothness | 1.41 (1.46) +0.05 | 1.36 (1.46) +0.1 | 1.58 (1.62) +0.04 |

TABLE 3-continued

Sheet properties of 50/50 blends, arithmetic means and synergy obtained

| | Clay I/OCGloss 50/50 | Clay I/OCPrint 50/50 | Clay I/C-95 50/50 |
|---|---|---|---|
| 75° Gloss | 45 (49) −4 | 46 (47) −1 | 42 (41) −1 |
| Brightness | 68.8 (68.8) 0 | 69.3 (68.9) +0.4 | 68.1 (67.8) +0.3 |
| Opacity | 87.8 (88.0) −0.2 | 88.3 (88.0) +0.3 | 87.7 (87.4) +0.3 |
| PPS Smoothness | 1.41 (1.36) −0.05 | 1.35 (1.36) +0.01 | 1.41 (1.52) +0.11 |

Example 2

In this Example, the properties of compositions according to the invention, in which particulate pigment comprises an aragonitic or rhombohedral precipitated calcium carbonate and a kaolin clay having a shape factor greater than or equal to about 25 and a steepness greater than or equal to 20 (clays B, C, D and E), was measured in comparison to compositions including single-component pigments and compositions including a fine particulate calcium carbonate having a generally spherical particle shape (Carbital 95).

The following pigments were tested:

100% Clay D
50:50 Clay D:OptiCalGloss
50:50 Clay D:OptiCalPrint
100% OptiCalPrint
100% Clay E
50:50 Clay E:OptiCalGloss
50:50 Clay E:OptiCalPrint
100% Clay C
50:50 Clay C:OptiCalGloss
50:50 Clay C:OptiCalPrint
100% Clay B
50:50 Clay B:OptiCalGloss
50:50 Clay B:OptiCalPrint
50:50 Clay D:C 95
50:50 Clay E:C 95
50:50 Clay C:C 95
50:50 Clay B:C 95
100% C 95.

A range of aqueous coating compositions was prepared at about 53% or 59% solids (see Table 4 for details), the solids portion comprising as follows:

100 parts pigment (total)
8 pph styrene-butadiene rubber latex (Dow 950)
8 pph hydroxyethyl starch (Penford Gum 280)
1 pph Nopcote C104 (calcium stearate)

The higher solids content of these compositions offers a useful benefit for dryer-limited paper mills, as it enables them to increase speed.

The colours were coated at 1000 m $min^{-1}$ onto Calcdonian mechanical LWC base using a Helicoater 2000D and short dwell head. The coated samples were calendered using 8 nips through the Perkins Supercalender at 65° C. and a pressure of 69 bar. The coating colour viscosities achieved with the different pigments are shown in Table 4 below.

TABLE 4

| Coating colour rheological properties | | | |
|---|---|---|---|
| Pigment/Blend | Solids wt % | Ferranti Shirley High shear viscosity mPa · s 12800 $s^{-1}$ | Brookfield 100 rpm Viscosity mPas |
| Clay D | 53.2 | 70 | 720 |
| Clay D/OptiCalGloss 50/50 | 56.1 | 72 | 740 |
| OptiCalGloss | 57.6 | 65 | 860 |
| Clay D/OptiCalPrint 50/50 | 56.1 | 70 | 680 |
| OptiCalPrint | 58.9 | 70 | 660 |
| Clay E | 52.8 | 74 | 560 |
| Clay E/OptiCalGloss 50/50 | 55.2 | 72 | 730 |
| Clay E/OptiCalPrint 50/50 | 55.2 | 76 | 600 |
| Clay C | 57.6 | 75 | 680 |
| Clay C/OptiCalGloss 50/50 | 57.8 | 76 | 780 |
| Clay C/OptiCalPrint 50/50 | 58.3 | 77 | 700 |
| Clay B | 56.4 | 69 | 1020 |
| Clay B/OptiCalGloss 50/50 | 56.7 | 75 | 900 |
| Clay B/OptiCalPrint 50/50 | 56.9 | 80 | 800 |
| Clay D/C95 50/50 | 57.5 | 87 | 960 |

TABLE 4-continued

| Coating colour rheological properties | | | |
|---|---|---|---|
| Pigment/Blend | Solids wt % | Ferranti Shirley High shear viscosity mPa · s 12800 $s^{-1}$ | Brookfield 100 rpm Viscosity mPas |
| Clay E/C95 50/50 | 57.0 | 90 | 780 |
| Clay C/C95 50/50 | 57.7 | 98 | 780 |
| Clay B/C95 50/50 | 57.0 | 72 | 790 |
| C95 | 59.7 | 83 | 1040 |

Results

Sheet properties are listed for each pigment or pigment blend in Table 5. The results are listed in order of increasing coating weight, 6, 8 and 10 $gm^{-2}$. For the blends, three numbers are listed for each property. These are firstly the measured property, then (in brackets) the arithmetic mean calculated from the results for the 100% components, and finally the increase or decrease due to blending. This represents the magnitude of any synergistic of antisynergistic effect. If the synergistic effect results in an improvement, then the result is listed as positive. If the result is a decrease in sheet quality, the result is listed as negative.

TABLE 5

| Sheet properties at 6, 8 and 10 gsm | | | | |
|---|---|---|---|---|
| Pigment | Gloss | B'ness | Opacity | PPS1000 kPa |
| Clay D | 56 | 69.3 | 86.7 | 1.03 |
| | 62 | 70.0 | 87.5 | 0.97 |
| | 67 | 70.5 | 88.1 | 0.91 |
| Clay D/ | 52 (50) +2 | 72.4 (71.3) +1.1 | 87.5 (87.0) +0.5 | 1.13 (1.19) +0.06 |
| OptiCalGloss | 58 (56) +2 | 73.6 (72.6) +1.0 | 88.6 (88.1) +0.5 | 1.02 (1.09) +0.07 |
| 50/50 | 62 (61) +1 | 74.4 (73.4) +1.0 | 89.4 (88.8) +0.6 | 0.93 (1.00) +0.07 |
| OptiCalGloss | 45 | 73.3 | 87.3 | 1.35 |
| | 51 | 75.1 | 88.6 | 1.20 |
| | 55 | 76.2 | 89.5 | 1.08 |
| Clay D/ | 47 (50) −3 | 72.6 (72.0) +0.4 | 87.7 (87.4) +0.3 | 1.11 (1.16) +0.05 |
| OptiCalPrint | 54 (56) −2 | 73.9 (73.1) +0.8 | 88.7 (88.2) +0.5 | 1.01 (1.06) +0.05 |
| 50/50 | 60 (60) 0 | 74.9 (74.0) +0.9 | 89.4 (88.9) +0.5 | 0.93 (0.99) +0.06 |
| OptiCalPrint | 44 | 74.7 | 88.0 | 1.28 |
| | 49 | 76.2 | 88.9 | 1.16 |
| | 53 | 77.4 | 89.6 | 1.07 |
| Clay D/ | 44 (44) 0 | 71.8 (70.7) +1.1 | 87.0 (86.5) +0.5 | 1.10 (1.28) +0.18 |
| C95 | 50 (50) 0 | 72.7 (71.6) +1.1 | 87.9 (87.2) +0.8 | 0.96 (1.19) +0.23 |
| 50/50 | 55 (55) 0 | 73.4 (72.2) +1.2 | 88.6 (87.9) +0.7 | 0.85 (1.12) +0.27 |
| C95 | 33 | 72.0 | 86.2 | 1.52 |
| | 38 | 73.1 | 87.0 | 1.40 |
| | 42 | 74.0 | 87.7 | 1.32 |
| Clay E | 57 | 70.0 | 86.8 | 1.04 |
| | 63 | 70.7 | 87.6 | 0.94 |
| | 67 | 71.2 | 88.3 | 0.87 |
| Clay E/ | 50 (51) −1 | 73.0 (71.7) +1.3 | 87.5 (87.1) +0.4 | 1.12 (1.19) +0.07 |
| OptiCalGloss | 57 (57) 0 | 74.1 (72.9) +1.2 | 88.5 (88.1) +0.4 | 1.00 (1.07) +0.07 |
| 50/50 | 63 (6.1) +2 | 74.9 (73.7) +1.2 | 89.3 (88.9) +0.4 | 0.92 (1.00) +0.08 |
| Clay E/ | 50 (50) 0 | 73.2 (72.4) +0.8 | 87.7 (87.4) +0.3 | 1.05 (1.16) +0.11 |
| OptiCalPrint | 56 (56) 0 | 74.3 (73.5) +0.8 | 88.9 (88.2) +0.7 | 0.97 (1.05) +0.08 |
| 50/50 | 61 (60) +1 | 75.2 (74.3) +0.9 | 89.8 (89.0) +0.8 | 0.90 (0.97) +0.07 |
| Clay E/ | 44 (45) −1 | 72.2 (71.0) +1.2 | 87.3 (86.5) +0.8 | 1.11 (1.28) +0.17 |
| C95 | 50 (50) 0 | 73.1 (71.9) +1.2 | 88.2 (87.3) +0.9 | 0.99 (1.17) +0.18 |
| 50/50 | 55 (55) 0 | 73.9 (72.6) +1.3 | 88.9 (88.0) +0.9 | 0.90 (1.09) +0.19 |
| Clay C | 53 | 70.8 | 86.7 | 1.07 |
| | 60 | 71.8 | 87.8 | 0.95 |
| | 64 | 72.5 | 88.5 | 0.87 |

TABLE 5-continued

| Sheet properties at 6, 8 and 10 gsm | | | | |
|---|---|---|---|---|
| Pigment | Gloss | B'ness | Opacity | PPS1000 kPa |
| Clay C/ | 49 (49) 0 | 73.2 (72.0) +1.2 | 87.5 (87.0) +0.5 | 1.08 (1.21) +0.13 |
| OptiCalGloss | 55 (55) 0 | 74.4 (73.5) +0.9 | 88.4 (88.2) +0.2 | 0.97 (1.07) +0.10 |
| 50/50 | 60 (60) 0 | 75.3 (74.4) +0.9 | 89.2 (89.0) +0.2 | 0.87 (0.97) +0.10 |
| Clay C/ | 51 (49) +2 | 73.6 (72.8) +0.8 | 87.9 (87.4) +0.5 | 1.03 (1.17) +0.14 |
| OptiCalPrint | 57 (55) +2 | 74.9 (74.0) +0.9 | 88.8 (88.4) +0.4 | 0.91 (1.05) +0.14 |
| 50/50 | 61 (59) +3 | 75.9 (75.0) +0.9 | 89.6 (89.1) +0.5 | 0.82 (0.97) +0.15 |
| Clay C | 41 (43) −2 | 72.5 (71.4) +1.1 | 87.0 (86.5) +0.5 | 1.20 (1.29) +0.09 |
| C95 | 47 (49) −2 | 73.4 (72.4) +1.0 | 87.8 (87.4) +0.4 | 1.09 (1.17) +0.08 |
| 50/50 | 52 (53) −1 | 74.1 (73.2) +0.9 | 88.5 (88.1) +0.4 | 1.00 (1.09) +0.09 |
| Clay B | 57 | 70.1 | 86.5 | 1.00 |
| | 62 | 70.6 | 87.4 | 0.87 |
| | 66 | 71.0 | 88.2 | 0.77 |
| Clay B/ | 57 (51) +6 | 73.2 (71.7) +1.5 | 87.8 (86.9) +0.9 | 1.04 (1.18) +0.14 |
| OptiCalGloss | 62 (56) +6 | 74.3 (72.9) +1.4 | 88.8 (88.0) +0.8 | 0.93 (1.03) +0.10 |
| 50/50 | 66 (60) +6 | 75.0 (73.6) +1.4 | 89.7 (88.8) +0.9 | 0.84 (0.93) +0.09 |
| Clay B/ | 48 (51) −3 | 72.9 (72.4) +0.6 | 87.7 (87.3) +0.4 | 1.08 (1.14) +0.06 |
| OptiCalPrint | 55 (56) −1 | 74.2 (73.4) +0.8 | 88.7 (88.2) +0.5 | 0.93 (1.02) +0.09 |
| 50/50 | 59 (60) −1 | 75.3 (74.2) +1.1 | 89.4 (88.9) +0.5 | 0.84 (0.92) +0.08 |
| Clay B/C95 | 46 (45) +1 | 72.3 (71.1) +1.2 | 87.0 (86.4) +0.6 | 1.13 (1.26) +0.13 |
| 50/50 | 51 (50) +1 | 73.1 (71.9) +1.2 | 87.9 (87.2) +0.7 | 1.05 (1.13) +0.08 |
| | 55 (54) +1 | 73.8 (72.5) +1.3 | 88.7 (88.0) +0.7 | 0.97 (1.04) +0.07 |

Example 3

In this Example, the properties of compositions in which the particulate pigment comprises an aragonitic precipitated calcium carbonate and a kaolin clay having a shape factor of 25 and a steepness above 20 (Clay F), were measured at different clay:PCC ratios in comparison to a composition including rhombohedral precipitated calcium carbonate in place of aragonitic PCC at the 60:40 clay:PCC ratio and compositions including single-component pigments.

For the blends, two numbers are listed for each property. These are firstly the measured property, then (in brackets) the arithmetic mean calculated from the results for the 100% components.

The composition and coating conditions were as stated in the heading to Table 6 below, which shows the results obtained.

TABLE 6

LWC - 8 gsm
Formulation: 8 parts Dow 950 latex, 9 parts PG 280 Starch + Stearate
Helicoating: 600 m/min, 45° Blade Angle, Caledonian LWX Base
Supercalendering: 8 nips, 1000 psi, 65° C.

| | Colour | Calendered Sheet Properties | | | | | | |
|---|---|---|---|---|---|---|---|---|
| | Solids | | B/ness | Opacity | Print Gloss | | Print Density | |
| Pigment Blend | Wt % | Gloss % | (ISO) | (ISO) | Dry | Litho | Dry | L/D |
| Clay F | 55.4 | 61 | 71.8 | 91.4 | 87 | 76 | 1.59 | 0.72 |
| Carbonate D | 56.0 | 54 | 77.0 | 92.3 | 70 | 67 | 1.45 | 0.97 |
| Carbonate E | 56.0 | 44 | 77.2 | 92.3 | 71 | 69 | 1.42 | 0.96 |
| Clay F/Carb D | 56.0 | 56 | 74.6 | 92.0 | 77 | 67 | 1.51 | 0.88 |
| 60:40 | | (58) | (73.9) | (91.8) | (88) | (72) | (1.53) | |
| Clay F/Carb D | 56.4 | 57 | 75.7 | 92.1 | 75 | 67 | 1.50 | 0.87 |
| 40:60 | | (57) | (74.9) | (91.9) | (77) | (71) | (1.51) | |
| Clay F/Carb E | 56.2 | 50 | 75.0 | 91.8 | 72 | 65 | 1.47 | 0.90 |
| 60:40 | | (54) | (74.0) | (91.8) | (81) | (73) | (1.52) | |

Example 4

In this example, the properties of compositions according to the invention, in which the particulate pigment comprises an aragonitic or rhombohedral precipitated calcium carbonate and a kaolin clay having a shape factor of 25 to 30 and steepness of greater than 20 (clay H) were measured at 50:50 blend ratios in comparison to compositions including single-component pigments.

For the blends, two numbers are listed for each property. These are firstly the measured property, then (in brackets) the arithmetic mean calculated from the results for the 100% components.

The composition and coating conditions were as stated in the heading to Table 7 below, which shows the results obtained. Table 8 below summarises the observed synergies.

TABLE 7

LWC
Formulation: 10 parts Dow 950 latex, 0.3 parts Finnfix 5 CMC Coating: 600 m/min, 45° Blade Angle, LWC Base
Soft Calendering: 20 m/min 1 nip, 300 kN/m$^2$, 100° C.

| | | Sheet Properties | | | | | Print Properties | | | | | |
|---|---|---|---|---|---|---|---|---|---|---|---|---|
| | Colour Solids | Sheet | Sheet B'ness | Sheet Opacity | Whiteness (−UV) | Coat Weight | Print Gloss | | | Print Density | | |
| Colour | Wt % | Gloss % | ISO | ISO | (D65) | GSM | Dry | Litho | Snap | Dry | Litho | L/D |
| | | | | | Sole Pigments | | | | | | | |
| Carbonate H | 66.5 | 55 | 76.3 | 86.0 | 64.3 | 8.5 | 68 | 63 | 13 | 1.42 | 1.41 | 0.99 |
| Carbonate G | 64.3 | 53 | 76.4 | 86.0 | 65.0 | 8.3 | 67 | 62 | 15 | 1.45 | 1.42 | 0.98 |
| Carbonate F | 64.3 | 48 | 76.7 | 85.5 | 65.0 | 8.3 | 65 | 59 | 17 | 1.42 | 1.40 | 0.99 |
| Carbonate I | 66.8 | 50 | 76.5 | 85.3 | 63.7 | 7.7 | 68 | 63 | 18 | 1.44 | 1.40 | 0.97 |
| Carbonate E | 67.1 | 53 | 77.1 | 86.4 | 64.3 | 8.1 | 71 | 68 | 18 | 1.43 | 1.40 | 0.98 |
| Carbonate C | 69.3 | 53 | 75.2 | 84.7 | 61.3 | 8.5 | 69 | 65 | 16 | 1.50 | 1.44 | 0.96 |
| Clay H | 61.7 | 61 | 73.0 | 86.2 | 57.4 | 7.7 | 80 | 64 | 19 | 1.50 | 1.21 | 0.81 |
| | | | | | 50:50 Blends with Clay H | | | | | | | |
| Carbonate H | 63.8 | 63 | 75.5 | 87.0 | 62.8 | 7.4 | 78 | 65 | 15 | 1.46 | 1.37 | 0.94 |
| | | (58) | (74.7) | (86.1) | (60.9) | | (74) | | | (1.46) | | |
| Carbonate G | 62.8 | 60 | 75.4 | 86.5 | 62.4 | 8.2 | 77 | 67 | 17 | 1.47 | 1.38 | 0.94 |
| | | (57) | (74.7) | (86.1) | (61.2) | | (74) | | | (1.48) | | |
| Carbonate F | 62.6 | 57 | 75.7 | 86.7 | 62.6 | 7.7 | 76 | 64 | 19 | 1.45 | 1.36 | 0.94 |
| | | (54.5) | (74.9) | (85.9) | (61.2) | | (72) | | | (1.46) | | |
| Carbonate I | 63.7 | 55 | 75.6 | 86.7 | 62.0 | 8.2 | 77 | 69 | 22 | 1.48 | 1.36 | 0.92 |
| | | (55.5) | (74.8) | (85.8) | (60.6) | | (74) | | | (1.47) | | |
| Carbonate E | 64.1 | 55 | 76.0 | 87.2 | 62.4 | 7.9 | 77 | 66 | 22 | 1.45 | 1.34 | 0.92 |
| | | (57) | (75.1) | (86.3) | (60.9) | | (76) | | | (1.47) | | |
| Carbonate C | 65.2 | 55 | 75.2 | 86.3 | 61.1 | 7.7 | 75 | 64 | 20 | 1.47 | 1.36 | 0.93 |
| | | (57) | (74.1) | (85.0) | (59.4) | | (75) | | | (1.50) | | |

TABLE 8

| Colour | Sheet Gloss % | Sheet B'ness ISO | Sheet Opacity ISO | Whiteness (−UV) (D65) | Print Gloss |
|---|---|---|---|---|---|
| Carbonate H | +5 | +0.8 | +0.9 | +1.9 | +4 |
| Carbonate G | +3 | +0.7 | +0.4 | +1.2 | +3 |
| Carbonate F | +3 | +0.8 | +0.8 | +1.4 | +4 |
| Carbonate I | 0 | +0.8 | +0.9 | +1.4 | +3 |
| Carbonate E | −2 | +0.9 | +0.9 | +1.5 | +1 |
| Carbonate C | −2 | +1.1 | +1.3 | +1.7 | 0 |

Example 5

In this Example, the effect on the synergies of varying the proportions of first:second components of the pigment blend was investigate in relation to Clay G and aragonitic PCC.

The composition and coating conditions were as stated in the heading to Table 9 below, which shows the results obtained. Table 10 below summarises the observed synergies.

TABLE 9

LWC
Formulation: 11 parts Dow 950 latex, 0.3 parts Finnfix 5 CMC
Coating: 600 m/min, 45o Blade Angle, LWC Base
Supercalendering: Standard Offset Conditions

| Colour | Colour Solids Wt % | Sheer Gloss % | Sheet Brightness ISO | Sheet Opacity ISO |
|---|---|---|---|---|
| Carbonate J | 64.9 | 56 | 76.3 | 86.8 |
| Clay G | 61.3 | 68 | 73.0 | 86.7 |

TABLE 9-continued

LWC
Formulation: 11 parts Dow 950 latex, 0.3 parts Finnfix 5 CMC
Coating: 600 m/min, 45o Blade Angle, LWC Base
Supercalendering: Standard Offset Conditions

| Colour | Colour Solids Wt % | Sheer Gloss % | Sheet Brightness ISO | Sheet Opacity ISO |
|---|---|---|---|---|
| 50:50 Carb. J:Clay G | 62.6 | 66 | 75.5 | 87.4 |
| | | (62) | (74.7) | (86.8) |
| 75:25 Carb. J:Clay G | 63.6 | 61 | 76.0 | 87.0 |
| | | (59) | (75.5) | (86.8) |

TABLE 10

| Colour | Sheet Gloss % | Sheet Brightness ISO | Sheet Opacity ISO |
|---|---|---|---|
| 50:50 Blend | +4 | +0.8 | +0.6 |
| 75:25 Blend | +2 | +0.5 | +0.2 |

Example 6

In this example, the effect on the synergies of varying proportions of first:second components of the pigment blend was investigated in relation to Clay H and aragonitic PCC. Table 11 below summarises the observed synergies.

TABLE 11

LWC
Formulation: 10 parts Dow 950 latex, 4 parts Cerestar (05598) starch + cross-linker
Coating: LDTA, 1400 m/min, 48° Blade Angle, 0.381 mm Blade,
LWC Base (39 gsm)
Supercalendering: 800 m/min 11 nips, 300 kN/m$^2$, 100° C.

| PCC/ Clay | Colour Solids | Sheet Gloss | Sheet Gloss | Sheet B'ness | Sheet Opacity | Print Gloss | | Print Density | |
|---|---|---|---|---|---|---|---|---|---|
| HRatio | Wt % | Side 1 | Side 2 | ISO | ISO | Dry | Litho | Dry | L/D |
| 30:70 | 56.6 | 62 | 54 | 71.6 | 91.8 | 71 | 59 | 1.43 | 0.87* |
| 50:50 | 59.7 | 64 | 59 | 72.4 | 92.1 | 73 | 63 | 1.47 | 0.92 |
| 70:30 | 60.0 | 58 | 50 | 72.9 | 91.5 | 67 | 60 | 1.45 | 0.96 |

It is seen that optimisation occurs around the 50:50 blend ratio. This ratio was selected for the following example.

Example 7

In this Example, the selected 50:50 ratio of calcium carbonate was compared against the comparison formulations:

Carbonate F:Clay K

Carbonate I:Clay K

Carbonate K:Clay K

The composition and coating conditions were as stated in the heading to Table 12 below.

TABLE 12

LWC
Formulation: 10 parts Dow 950 latex, 4 parts Cerestar (05598) starch + cross-linker
Coating: LDTA, 1400 m/min, 48° Blade Angle, 0.381 mm Blade, LWC Base (39 gsm)
Supercalendering: 800 m/min 11 nips, 300 kN/m$^2$, 100° C.

| Colour (all | Colour Solids | Sheet Gloss | Sheet Gloss | Sheet B'ness | Sheet Opacity | Print Gloss | | Print Density | |
|---|---|---|---|---|---|---|---|---|---|
| 50:50 blends) | Wt % | Side 1 | Side 2 | ISO | ISO | Dry | Litho | Dry | L/D |
| Carb F/Clay H | 59.7 | 64 | 59 | 72.4 | 92.1 | 73 | 63 | 1.47 | 0.92 |
| Carb F/Clay K | 60.0 | 67 | 60 | 71.7 | 91.7 | 66 | 60 | 1.42 | 0.96 |
| Carb. I/Clay K | 61.2 | 66 | 59 | 71.1 | 91.3 | 69 | 63 | 1.42 | 0.95 |
| Carb. K/Clay K | 61.3 | 57 | 50 | 70.4 | 90.9 | 61 | 56 | 1.42 | 0.96 |

Example 8

In this Example, 80:20 blends of calcium carbonate:clay using Carbonate M and Clays G and H were compared against the comparison formulations:

Carbonate M:Clay K

Carbonate K:Clay K

Carbonate L:Clay K

Carbonate I:Clay K

Two different topcoating techniques were used, the results being shown in Tables 13 and 14 below and the compositions and coating conditions were as stated in the respective leadings to those tables.

TABLE 13

Topcoating
Formulation: 10 parts Dow 950 latex, 0.3 parts Finnfix 5 CMC and 0.5 parts OBA
Coating: LDTA, 800 m/min, Bent Blade (0.381 mm), Precoated Woodfree Base
Supercalendering: 800 m/min 11 nips, 300 kN/m$^2$, 100° C.

| Colour All 80 parts | Colour Solids | Sheet | Sheet B'ness | Sheet Opacity | W'ness (+UV) | Print Gloss | | Print Density | |
|---|---|---|---|---|---|---|---|---|---|
| Carbonate | Wt % | Gloss % | ISO | ISO | D65 | Dry | Litho | Dry | L/D |
| Carb. M/Clay H | 60.3 | 80 | 87.4 | 89.2 | 107.6 | 93 | 88 | 1.54 | 0.97 |
| Carb. M/Clay G | 61.8 | 79 | 87.5 | 89.5 | 107.4 | 93 | 89 | 1.53 | 0.97 |
| Carb. M/Clay K | 62.9 | 79 | 86.9 | 89.7 | 104.8 | 90 | 87 | 1.54 | 0.98 |

TABLE 13-continued

Topcoating
Formulation: 10 parts Dow 950 latex, 0.3 parts Finnfix 5 CMC and 0.5 parts OBA
Coating: LDTA, 800 m/min, Bent Blade (0.381 mm), Precoated Woodfree Base
Supercalendering: 800 m/min 11 nips, 300 kN/m$^2$, 100° C.

| Colour All 80 parts | Colour Solids | Sheet | Sheet B'ness | Sheet Opacity | W'ness (+UV) | Print Gloss | | Print Density | |
|---|---|---|---|---|---|---|---|---|---|
| Carbonate | Wt % | Gloss % | ISO | ISO | D65 | Dry | Litho | Dry | L/D |
| Carb. K/Clay K | 67.3 | 77 | 86.9 | 88.4 | 106.9 | 94 | 89 | 1.56 | 0.97 |
| Carb. L/Clay K | 66.6 | 78 | 87.3 | 88.7 | 108.7 | 93 | 91 | 1.55 | 0.97 |
| Carb. I/Clay K | 64.0 | 76 | 87.3 | 89.3 | 103.6 | 93 | 88 | 1.51 | 0.96 |

TABLE 14

Topcoating
Formulation: 10 parts Dow 950 latex, 0.3 parts Finnfix 5 CMC and 0.5 parts OBA
Coating: 600 m/min, 45° angle, 65 gsm Uncoated Woodfree Base
Soft Calendering: 800 m/min, 1 nips, 300 kN/m$^2$, 100° C.

| | Colour Solids | Sheet | Roughness PPS | Sheet B'ness | Sheet Opacity | W'ness (+UV) | Print Gloss | |
|---|---|---|---|---|---|---|---|---|
| Colour | Wt % | Gloss % | 5 kPa | ISO | ISO | (D65) | Dry | Litho |
| Carb. K/Clay K 70:30 | 68.3 | 76 | 0.68 | 81.4 | 86.4 | 92.9 | 91 | 87 |
| Carb. M/Clay G 50:50 | 62.2 | 77 | 0.60 | 82.4 | 87.8 | 92.5 | 91 | 88 |
| Carb. M.Clay G 70:30 | 65.1 | 74 | 0.73 | 83.2 | 87.4 | 95.7 | 90 | 87 |

Example 9

This example illustrates the performance of a 50:50 mixture of aragonite and rhombohedral PCC in a pigment containing a blocky particulate kaolin (Clay K).

A 75 gsm pre-coated woodfree base was coated on a Heli-Coater™ using a blade applicator at 1200 m/min with the coatings being run at the maximum runnable solids. The formulation was 83 parts carbonate and 17 parts kaolin with 9 parts of latex (4.5 pph styrene acrylic latex Acronal S360D; 4.5 pph styrene butadiene latex Dow DL940), 1 part PVOH, 0.6 parts OBA (Tinopal ABP), 0.3 parts CMC and 0.6 parts calcium stearate at ph 8.5. The coat weight range was 8-12 gsm and the data were interpolated to 10 gsm.

The kaolins were Clays J and K. The PCC was prepared from Carbonates A and B. The results are shown in Table 15 below.

TABLE 15

| Pigment | Gloss (TAPPI) | Brightness (ISO) | Opacity (TAPPI) | Print gloss (TAPPI) | Snap (print gloss-gloss) |
|---|---|---|---|---|---|
| Conventional Fine ground GCC/Clay K Control | 79 | 91.8 | 88.3 | 88 | 9 |
| Rhombo/ Aragonite 50:50/ Clay K | 78 | 92.1 | 89.4 | 89 | 11 |

As shown in Table 16 below, similar behaviour was observed when the kaolin was changed to Clay J.

TABLE 16

| Pigment | Gloss (TAPPI) | Brightness (ISO) | Opacity (TAPPI) | Print gloss (TAPPI) | Snap (print gloss-print) |
|---|---|---|---|---|---|
| Rhombo/ Aragonite 50:50/Clay J | 78 | 92.1 | 89.4 | 89 | 11 |

The above data illustrate the desirable effect of using a 1:1 wt./wt. blend of aragonite and rhombohedral PCC. This gave, compared to the GCC control; minus one unit of gloss, +0.3 units of brightness, +1.1 units of opacity, +1 unit of print gloss and a snap value of +11 compared to +9 with the control.

Discussion

This work confirms that synergistic advantages in the properties of gloss, brightness, opacity and smoothness, or at least some of them, occur when the combinations of particulate calcium carbonate and particulate kaolin clays according to the present invention are employed as pigments in paper coating compositions.

Generally speaking, the advantages are shown at all conventional coating weights on the paper. However, when the particulate kaolin clay has a relatively high shape factor, simultaneously with a relatively low mean equivalent particle diameter and relatively high steepness, the advantages are more pronounced at higher coating weights.

Generally speaking, aragonitic precipitated calcium carbonate is preferred as the first component of the pigment system according to the present invention. The ratio of calcium carbonate to kaolin clay is suitably around 50:50.

The invention claimed is:

1. A pigment composition comprising:

(a) a precipitated calcium carbonate comprising a mixture of aragonitic particles and rhombohedral particles in a weight ratio ranging from 40:60 to 60:40 based on aragonitic:rhombohedral, and (b) a kaolin clay with a shape factor greater than 25 and a steepness greater than or equal to 20.

2. The composition of claim 1, wherein the precipitated calcium carbonate comprises a predominantly rhombohedral precipitated calcium carbonate.

3. The composition of claim 2, wherein the predominantly rhombohedral precipitated calcium carbonate has a $d_{50}$ of less than about 0.8 microns.

4. The composition of claim 2, wherein the predominantly rhombohedral precipitated calcium carbonate has a $d_{50}$ of less than about 0.7 microns.

5. The composition of claim 2, wherein the predominantly rhombohedral precipitated calcium carbonate has a $d_{50}$ of at least about 0.2 microns.

6. The composition of claim 2, wherein the predominantly rhombohedral precipitated calcium carbonate has a $d_{50}$ ranging from about 0.25 microns to about 0.45 microns.

7. The composition of claim 2, wherein the predominantly rhombohedral precipitated calcium carbonate has a $d_{50}$ ranging from about 0.4 microns to about 0.6 microns.

8. The composition of claim 2, wherein the predominantly rhombohedral precipitated calcium carbonate has a particle size distribution such that at least about 93% by weight of the particles have an equivalent spherical diameter less than 2 microns.

9. The composition of claim 2, wherein the predominantly rhombohedral precipitated calcium carbonate has a particle size distribution such that at least about 86% by weight of the particles have an equivalent spherical diameter less than 1 micron.

10. The composition of claim 2, wherein the predominantly rhombohedral precipitated calcium carbonate has a particle size distribution such that at least about 22% by weight of the particles have an equivalent spherical diameter less than 0.5 microns.

11. The composition of claim 2, wherein the predominantly rhombohedral precipitated calcium carbonate has a particle size distribution ranging from 5% to 25% by weight of the particles have an equivalent spherical diameter less than 0.25 microns.

12. The composition of claim 2, wherein the predominantly rhombohedral precipitated calcium carbonate has a GE brightness of at least 90.

13. The composition of claim 2, wherein the predominantly rhombohedral precipitated calcium carbonate has a GE brightness of at least 92.

14. The composition of claim 2, wherein the kaolin clay has a shape factor greater than 30.

15. The composition of claim 2, wherein the predominantly rhombohedral precipitated calcium carbonate has a particle size distribution such that:

at least 93% by weight of the particles have an equivalent spherical diameter of less than 2 microns;

at least 86% by weight of the particles have an equivalent spherical diameter of less than 1 micron;

at least 22% by weight of the particles have an equivalent spherical diameter of less than 0.5 microns; and from 5% to 25% by weight of the particles have an equivalent spherical diameter less than 0.25 microns.

16. The composition of claim 1, wherein the precipitated calcium carbonate comprises a predominantly aragonitic precipitated calcium carbonate.

17. The composition of claim 16, wherein the predominantly aragonitic precipitated calcium carbonate has a $d_{50}$ of less than about 0.8 microns.

18. The composition of claim 16, wherein the predominantly aragonitic precipitated calcium carbonate has a $d_{50}$ of less than about 0.7 microns.

19. The composition of claim 16, wherein the predominantly aragonitic precipitated calcium carbonate has a $d_{50}$ of at least about 0.2 microns.

20. The composition of claim 16, wherein the predominantly aragonitic precipitated calcium carbonate has a $d_{50}$ ranging from 0.25 microns to about 0.45 microns.

21. The composition of claim 16, wherein the predominantly aragonitic precipitated calcium carbonate has a particle size distribution such that at least about 90% by weight of the particles have an equivalent spherical diameter less than 2 microns.

22. The composition of claim 16, wherein the predominantly aragonitic precipitated calcium carbonate has a particle size distribution such that at least about 75% by weight of the particles have an equivalent spherical diameter less than 1 micron.

23. The composition of claim 16, wherein the predominantly aragonitic precipitated calcium carbonate has a particle size distribution such that at least about 60% by weight of the particles have an equivalent spherical diameter less than 0.5 microns.

24. The composition of claim 16, wherein the predominantly aragonitic precipitated calcium carbonate has a particle size distribution ranging from 15% to 40% by weight of the particles have an equivalent spherical diameter less than 0.25 microns.

25. The composition of claim 16, wherein the predominantly aragonitic precipitated calcium carbonate has a GE brightness of at least 90.

26. The composition of claim 16, wherein the predominantly aragonitic precipitated calcium carbonate has a GE brightness of at least 92.

27. The composition of claim 16, wherein the kaolin clay has a shape factor greater than 25.

28. The composition of claim 16, wherein the predominantly aragonitic precipitated calcium carbonate has a particle size distribution such that:

at least 90% by weight of the particles have an equivalent spherical diameter of less than 2 microns;

at least 75% by weight of the particles have an equivalent spherical diameter of less than 1 micron;

at least 60% by weight of the particles have an equivalent spherical diameter of less than 0.5 microns; and from 15% to 40% by weight of the particles have an equivalent spherical diameter less than 0.25 microns.

29. The composition of claim 16, wherein the predominantly aragonitic precipitated calcium carbonate has a particle size distribution such that:

at least 95% by weight of the particles have an equivalent spherical diameter of less than 2 microns;

at least 82% by weight of the particles have an equivalent spherical diameter of less than 1 micron;

at least 66% by weight of the particles have an equivalent spherical diameter of less than 0.5 microns; and from 23% to 33% by weight of the particles have an equivalent spherical diameter less than 0.25 microns.

30. The composition of claim 1, wherein the kaolin clay has a shape factor greater than about 30.

31. The composition of claim 1, wherein the kaolin clay has a shape factor greater than about 35.

32. The composition of claim 1, wherein the kaolin clay has a shape factor greater than about 45.

33. The composition of claim 1, wherein the kaolin clay has a $d_{50}$ of less than about 0.5 microns.

34. The composition of claim 1, wherein the kaolin clay has a $d_{50}$ ranging from about 0.1 microns to about 0.5 microns.

35. The composition of claim 1, wherein the kaolin clay has a $d_{50}$ of greater than about 0.5 microns.

36. The composition of claim 1, wherein the kaolin clay has a $d_{50}$ ranging from about 0.5 microns to about 1.5 microns.

37. The composition of claim 1, wherein the kaolin clay has a steepness ranging from about 25 to about 45.

38. The composition of claim 1, wherein the kaolin clay has a steepness ranging from about 35 to about 45.

39. The composition of claim 1, wherein the kaolin clay comprises at least 50% by weight kaolinite.

40. The composition of claim 1, wherein the kaolin clay comprises greater than 75% by weight kaolinite.

41. The composition of claim 1, wherein the kaolin clay comprises greater than 90% by weight kaolinite.

42. The composition of claim 1, wherein the kaolin clay has a GE brightness of at least 85.

43. The composition of claim 1, wherein the kaolin clay has a GE brightness of at least 90.

44. The composition of claim 1, wherein the precipitated calcium carbonate comprises at least about 40% by weight relative to the total composition.

45. The composition of claim 1, wherein the precipitated calcium carbonate comprises at least about 70% by weight relative to the total composition.

46. The composition of claim 1, wherein the precipitated calcium carbonate comprises not more than about 75% by weight relative to the composition.

47. A coating composition for paper and other substrates, the composition comprising an aqueous suspension of a particulate pigment according to claim 1 and a binder.

48. The composition according to claim 47, wherein the binder comprises a modified starch.

49. The composition according to claim 47, further comprising at least one additional component chosen from: cross linkers; water retention aids; viscosity modifiers and thickeners; lubricity/calendering aids; dispersants; antifoamers/defoamers; dry and wet pick improvement additives; dry and wet rub improvement and/or abrasion resistance additives; gloss-ink hold-out additives; optical brightening agents (OBA) and/or fluorescent whitening agents (FWA); dyes; biocides/spoilage control agents; levelling and evening aids; grease and oil resistance additives; water resistance additives; additional pigments; and mixtures thereof.

50. The composition according to claim 49, consisting essentially of the aqueous suspension of the particulate pigment, the binder, and the at least one additional component, with less than about 10% by weight of the at least one additional component.

51. A method for preparing a coating composition comprising an aqueous suspension of a particulate pigment according to claim 1 and a binder, comprising: mixing the particulate pigment and the binder into an aqueous liquid medium to prepare a suspension of the solid components therein.

52. A method for preparing a coated gloss paper comprising: applying to the paper a composition comprising an aqueous suspension of a particulate pigment according to claim 1 and a binder and calendering the paper to form a gloss coating thereon.

53. A paper coated with a gloss coating comprising a dry residue of a composition comprising an aqueous suspension of a particulate pigment according to claim 1 and a binder.

54. The paper according to claim 53, which is a coated mechanical paper.

55. The paper according to claim 53, which is a coated lightweight coated paper (LWC).

* * * * *